US005326254A

United States Patent [19]

Munk

[11] Patent Number: 5,326,254

[45] Date of Patent: Jul. 5, 1994

[54] FOG CONDITIONED FLUE GAS RECIRCULATION FOR BURNER-CONTAINING APPARATUS

[76] Inventor: Michael Munk, 130 Gun Club Rd., Stamford, Conn. 06903

[21] Appl. No.: 17,521

[22] Filed: Feb. 26, 1993

[51] Int. Cl.[5] ..... F23B 5/02

[52] U.S. Cl. ..... 431/115; 110/204; 110/205; 110/215; 110/345; 431/9

[58] Field of Search ..... 110/204, 205, 215, 345; 431/115, 4, 9

[56] References Cited

U.S. PATENT DOCUMENTS

| | | | |
|---|---|---|---|
| 3,788,066 | 1/1974 | Nebgen | 60/39.05 |
| 4,231,333 | 11/1980 | Thatcher et al. | 123/440 |
| 4,313,300 | 2/1988 | Wilkes et al. | 60/39.02 |
| 4,417,547 | 11/1983 | Goodman et al. | 123/25 J |
| 4,418,527 | 12/1983 | Schlom et al. | 60/39.53 |
| 4,424,667 | 1/1984 | Fanning | 60/728 |
| 4,667,465 | 5/1987 | Munk | 60/39.3 |
| 4,699,071 | 10/1987 | Vier et al. | 110/205 X |
| 4,702,074 | 10/1987 | Munk | 60/39.511 |
| 4,714,032 | 12/1987 | Dickinson | 60/39.05 |
| 4,731,988 | 3/1988 | Munk | 60/39.3 |
| 4,731,990 | 3/1988 | Munk | 60/39.05 |
| 4,773,846 | 9/1988 | Munk | 431/4 |
| 4,928,478 | 5/1990 | Maslak | 60/39.05 |
| 4,942,832 | 7/1990 | Finke | 431/115 X |
| 5,129,818 | 7/1992 | Balsiger | 431/115 X |
| 5,163,282 | 11/1992 | Phillips et al. | 60/39.05 |
| 5,224,851 | 7/1993 | Johnson | 431/115 |

FOREIGN PATENT DOCUMENTS

| | | | |
|---|---|---|---|
| 0180731 | 10/1983 | Japan | 60/728 |
| 3258926 | 11/1991 | Japan | 60/728 |
| 1588987 | 8/1990 | U.S.S.R. | 431/115 |

OTHER PUBLICATIONS

G. Tompkins, "Flue Gas Recirculation Works For Packaged Boilers Too", POWER, Apr., 1990.

Thames et al., "On-Line Compressor Washing Practices And Benefits", pp. 1-6. (1989).

*Primary Examiner*—Edward G. Favors

*Attorney, Agent, or Firm*—Martin M. Novack

[57] ABSTRACT

The disclosure is directed to a burner-containing apparatus, such as a boiler or a furnace, having reduced noxious emissions. A burner receives input air and has an exhaust for exhausting flue gases. A flue gas recirculation system is provided for recirculating a portion of the flue gases back to an input of the burner. A fogging device, which produces a fog from a fogger water supply and a fogger air supply, humidifies the recirculated flue gases.

17 Claims, 4 Drawing Sheets

FOG CONDITIONED FLUE GAS RECIRCULATION FOR BURNER-CONTAINING APPARATUS

FIELD OF THE INVENTION

This invention relates to apparatus employing a burner and, more particularly, to improvements in a burner-containing apparatus that utilizes flue gas recirculation.

BACKGROUND OF THE INVENTION

Flue gas recirculation has been used in various types of systems to reduce noxious exhaust emissions. A prior art flue gas recirculation apparatus, used in a boiler system, is illustrated in FIG. 1. A boiler system 100 includes a boiler 110 that has a burner, represented at 115 with a controlled air input 116. An exhaust stack, represented at 120, exhausts the flue gases from the system via breeching 117. A recirculation section 130 includes a damper 132 that communicates with the exhaust stack 120 and permits a portion of the flue gases to be drawn by a blower 134 through a duct 135 that couples back to a further input of the burner 115. A sensor 136, which senses noxious emissions (typically, oxides of nitrogen, or "$NO_x$") is coupled to a controller 137, the output of which controls a recirculation supply damper 138.

In operation, a selected fraction of the flue gases is recirculated to the burner. The prior art literature indicates that flue gas recirculation acts as a flame quencher, reducing combustion temperatures by thermal dilution. In doing so, among other indicated advantages, it significantly reduces excess air requirements, flame temperature, and flue gas heat loss, thereby reducing $NO_x$ emissions and improving boiler efficiency (see e.g. G . Tompkins, "Flue Gas Recirculation Works For Packaged Boilers Too", POWER, April, 1990). In the FIG. 1 apparatus, the sensor 136 and controller 137 sense the concentration of noxious emissions in the exhaust gas, increase the recirculation fraction when $NO_x$ emissions increase, and reduce the recirculation fraction when $NO_x$ emissions decrease.

Although existing flue gas recirculation techniques are useful in reducing noxious emissions and improving boiler efficiency, they have limitations. For example, although noxious emissions tends to decrease as the fraction of recirculated flue gas is increased, there is a limit on the fraction of recirculated flue gas that can be fed back to the burner input. The upper limit is approximately 25% recirculation. Above this level, the burner flame tends to become unstable, which can severely limit the efficiency of the burner. Accordingly, further reductions in noxious emissions that might result from higher percentage flue gas recirculation generally cannot be achieved.

It is among the objects of the present invention to attain further reduction in noxious emissions without undue sacrifice of flame stability and/or burner efficiency.

SUMMARY OF THE INVENTION

The present invention is directed to a burner-containing apparatus, such as a boiler or a furnace, having reduced noxious emissions. A burner receives input air and has an exhaust for exhausting flue gases. A flue gas recirculation system is provided for recirculating a portion of the flue gases back to an input of the burner. In accordance with a feature of the invention, means are provided for humidifying the recirculated flue gases.

In a preferred embodiment of the invention, the humidifying means comprises a fogging device which produces a fog from a logger water supply and a fogger air supply. An embodiment of the disclosed invention uses ultrasonic foggers which can modulate the fog quantity and maintain evaporation to dryness which helps prevent corrosion in burner-containing systems where relatively expensive corrosion-resistant materials have not been used.

In a disclosed embodiment, means are provided for sensing the temperature of the humidified flue gases, and for controlling the amount of fogging as a function of the sensed temperature.

An advantage of the invention is the achievement of greater $NO_x$ reduction for a given flue gas recirculation fraction. A further advantage stems from the greater ease of handling flue gases which may typically have a temperature before fogging of about 500 degrees F., and are rendered substantially cooler and denser by the fogging hereof. In an embodiment of the invention, a boiler system fired with natural gas has its recirculated flue gases flash cooled with fog to about (i.e., within $\pm 10\%$ of) 200 degrees F. For an oil fired system, fogging to a temperature of about 250 degrees F. is used.

Chemicals known to reduce $NO_x$, such as urea ($NH_2$—CO—$NH_2$) or ammonia ($NH_3$), can be mixed into the fogger water supply to further reduce stack gas $NO_x$ content at lower flue gas recirculation rates.

Further features and advantages of the invention will become more readily apparent from the following detailed description when taken in conjunction with the accompanying drawings.

DETAILED DESCRIPTION

Figure 1:
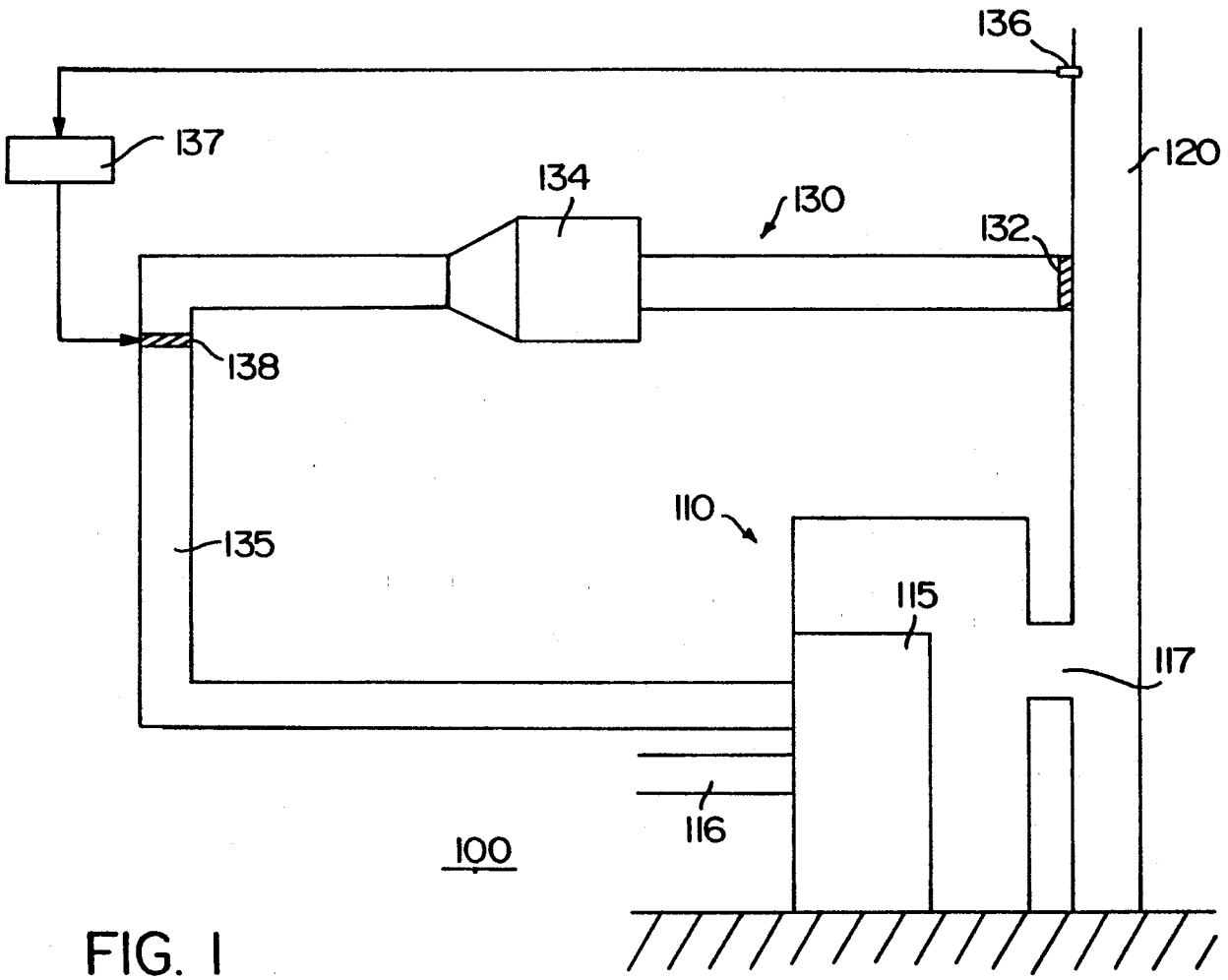
FIG. 1 PRIOR ART
FIG. 1 is a schematic diagram, partially in block form, of a prior art boiler system employing a flue gas recirculation apparatus.
Figure 2:
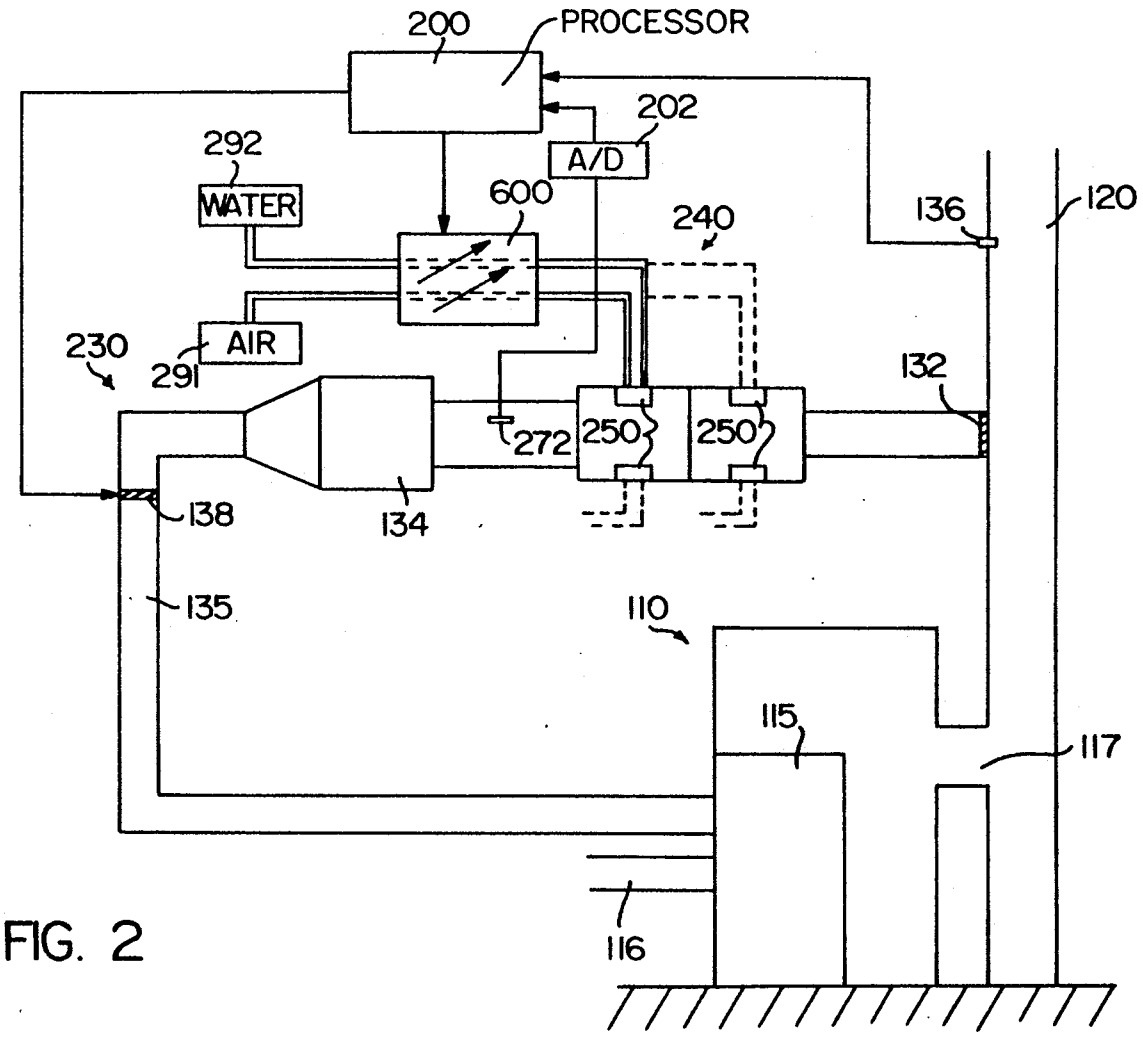
FIG. 2 is a schematic diagram, partially in block form, of an apparatus in accordance with an embodiment of the invention.

Referring to FIG. 2, there is shown a diagram of a burner-containing apparatus, in this example a boiler apparatus, that includes improvements in accordance with an embodiment of the invention. Components of the apparatus of FIG. 2 which have reference numerals corresponding to those of the apparatus of FIG. 1 correspond generally to such components of FIG. 1. In particular, the boiler 110 includes a burner 115, breeching 117, and an exhaust stack 120. A flue gas recirculation system, in this case designated by reference numeral 230, includes a damper 132, blower 134, recirculation supply damper 138, and duct 135 which couples to a recirculation input of burner 115. In the illustration, and as above, the burner also has an air input 116. It will be understood that these inputs can either be separately fed to burner or can be mixed at any desired point. A noxious emissions sensor 136, for example a $NO_x$ sensor as above, in this case provides an input to a processor 200 which, in turn, provides an output control signal to the recirculation supply damper 138. A variable output blower motor could also be employed.

In accordance with the improvements of the present embodiment of the invention, a fogging subsystem 240 is provided in the recirculation system 230. The fogging subsystem 240, includes one or more fogging devices, four of which are shown in FIG. 2, and represented by reference numeral 250.

Figure 3:
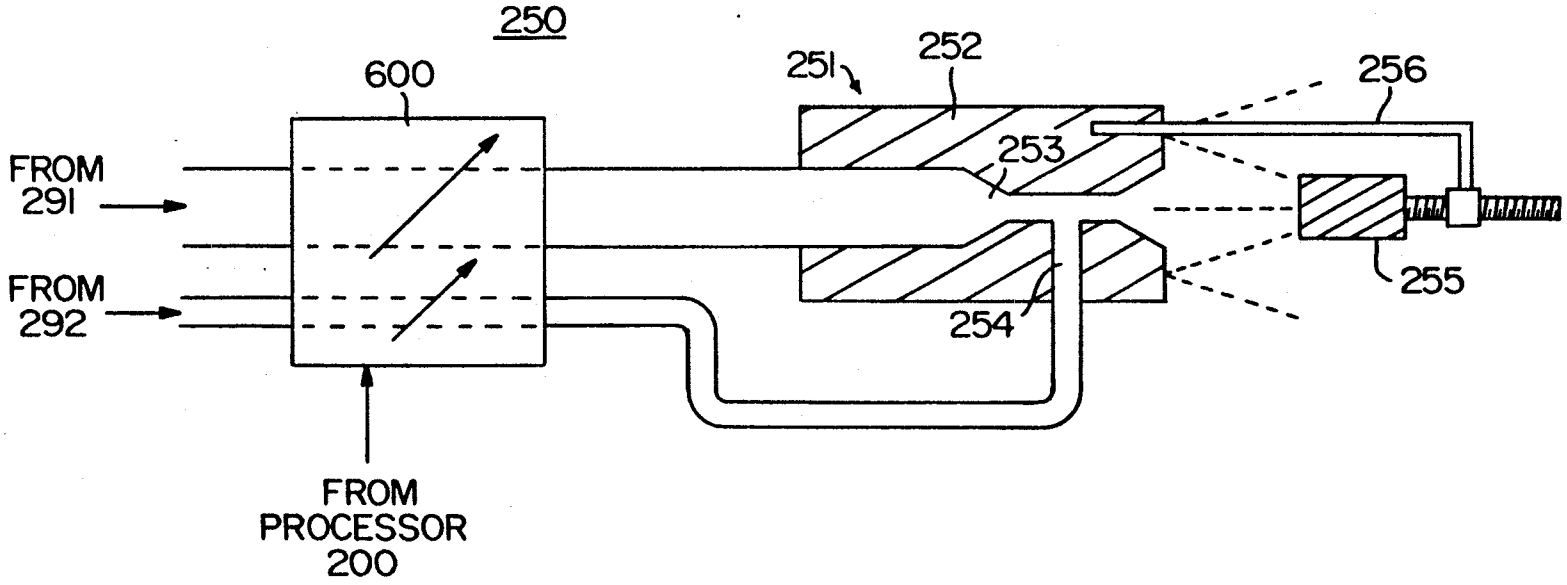
FIG. 3 is a diagram, partially in schematic cross-sectional form, of a fogging unit that can be utilized in an embodiment of the invention.

As used herein, "fog" means water droplets in air that have a size of the order of 10 microns or less, are relatively unstable due to their small volume as compared to their surface area, and therefore evaporate to dryness in the air. The water droplets are propelled by the force of compressed air at velocities high enough to assure uniform mixing through cross flow injection into a receiving gas stream, which in this case is flue gases typically including the combustion products nitrogen, carbon dioxide, water vapor, and $NO_x$. An example of a fogging device 250, as also disclosed in U.S. Pat. Nos. 4,667,465, 4,702,074, 4,731,990, 4,773,846, and 4,731,988, is shown in simplified form in FIG. 3.

Each fogging device of the present embodiment may comprise a nozzle 251 having a cylindrical body 252 with a central bore 253. Compressed air (or steam at equivalent pressure) from a source 291 (see also FIG. 2) is coupled to the bore 253. Water under pressure, from a source 292, is coupled through a transversely disposed conduit 254 that communicates with the bore 253. An adjustable resonator plug 255, facing the nozzle opening at the front end of bore 253, is mounted on an "L"-shaped standoff 256 that extends from body 252 and permits controlled dispersion of the fog by varying the distance from orifice discharge to plug 255.

In operation, as the pressurized air pulsates through the bore 253, water pulsates through the conduit 254 and is entrained within the air flow along the bore 253. The ultrasonic standing shock wave in the bore shears the water particles into fine droplets. The resonator plug 255 reflects the high speed air against the emerging water particles or droplets in a manner that reduces the water droplets to a size of the order of 10 microns or less, and deflects these minute droplets outward for cross flow mixing with the gas flow passing through the fogging subsystem 200. The droplets are formed in a tunable field whose shape can be selected by the variable distance between the opening and front flat reflective face of nozzle 251 and the resonator cup 255. The flow of both compressed air and water input to the fogging devices 250 is controlled by a control unit 600, so as to increase or decrease the volume of generated fog at uniform fog density. As described in detail in the above-referenced U.S. Patents, the control unit can, in turn be under control of processor which operates to control the fogging. [For example, as disclosed in said Patents, the level of fogging added to input air of a turbine power generation system can be controlled in accordance with the concentration of noxious emissions sensed in the system's exhaust.]

In accordance with an embodiment of the invention, a temperature sensing transducer 272 senses the temperature of the fogged recirculated flue gases, and the output of sensor 272 is coupled to processor 200 via analog-to-digital converter 202. The amount of fogging provided by fogging subsystem 250 is controlled in accordance with the temperature sensed by temperature sensor 272.

Figure 4:
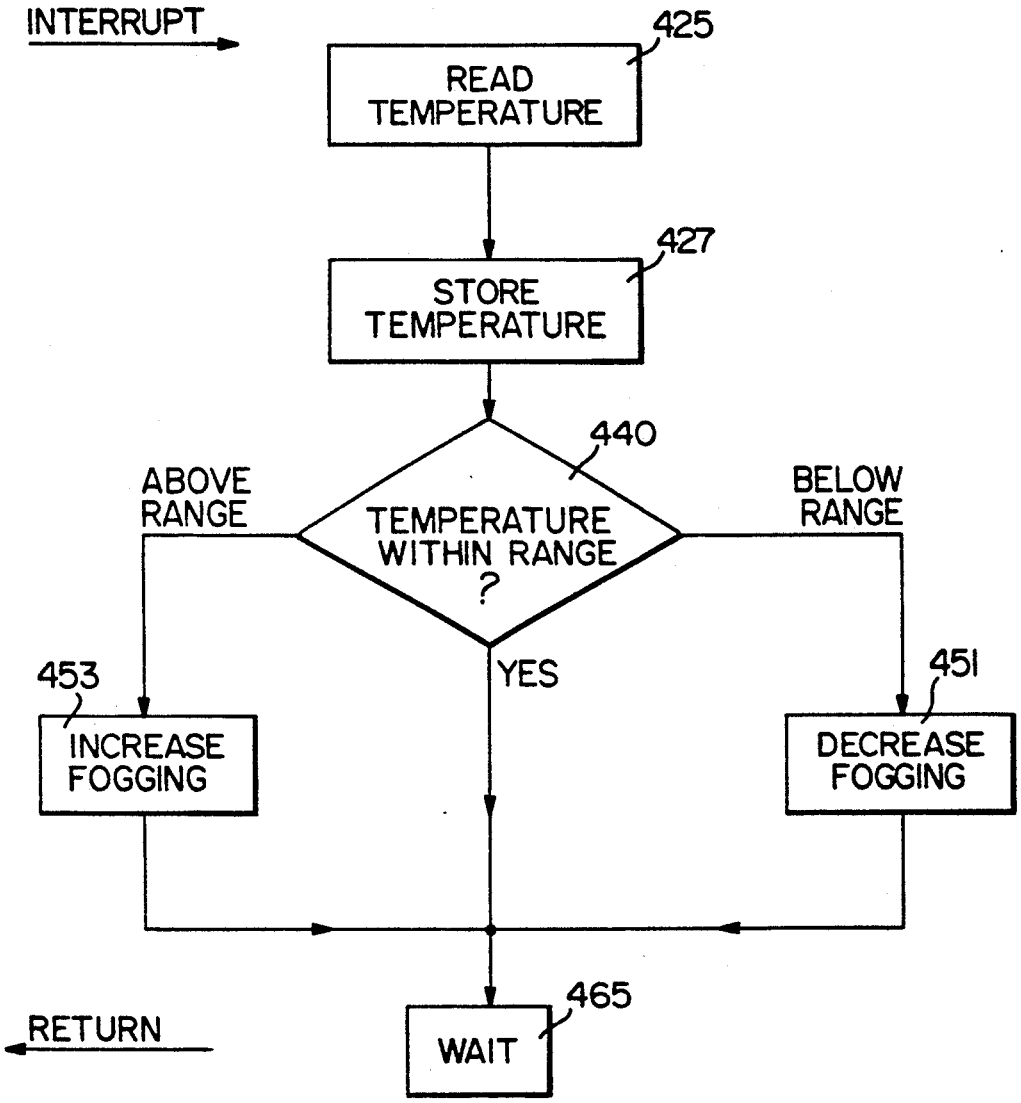
FIG. 4 is a flow diagram of a routine that can be utilized to program the processor of FIG. 2 in accordance with an embodiment of the invention.

FIG. 4 shows a flow diagram of a routine for controlling the processor 200 (FIG. 2) to control fogging in accordance with the temperature of fogged flue gases. The processor 200 may comprise any suitable microprocessor, such as a Model 360 or 460 processor sold by Intel Corp. or other suitable general or special purpose digital or analog processor, having the conventional associated clock, memory, and input/output peripherals. In the routine of FIG. 4, interrupt signals are generated periodically or at a rate determined by the operator. Upon an occurrence of an interrupt signal, the signals from the temperature sensor are read and stored, as represented by the blocks 425–427. Inquiry is then made (decision diamond 440) as to whether the sensed temperature is within the prescribed range $T_{min}$ to $T_{max}$ (which results in block 465 being entered), is less than the minimum temperature of the range, $T_{min}$ (which causes block 451 to be entered), or is above the maximum temperature of the range, $T_{max}$ (which causes the block 453 to be entered). If the sensed temperature is above the maximum temperature of the operating range, $T_{max}$, fogging is increased, such as by sending an appropriate control signal to unit 600 which can turn on or adjust fogging units or additional fogging units within subsystem 250. This control is represented by the block 453. The block 465 is then entered, to await the next interrupt. [Alternatively, return can be immediately be effected to program control.] Conversely, if the sensed temperature is below the minimum temperature of the operating range, $T_{min}$, the block 451 represents the implementation of control to decrease fogging by adjusting or turning off one or more fogging units within the fogging subsystem. The block 465 is then entered. When the sensed temperature is within the prescribed temperature range, the block 465 is entered directly, and no fogger subsystem control is implemented for the present cycle. The processor can, for example, perform the described sense and control routine at specified intervals. It will be understood that various other control routines could be employed with similar result.

An advantage of the invention is the achievement of greater $NO_x$ reduction for a given flue gas recirculation fraction. A further advantage stems from the greater ease of handling flue gases which may typically have a temperature before fogging of about 500 degrees F., and are rendered substantially cooler and denser by the fogging hereof. A boiler system fired with natural gas can have its recirculated flue gases flash cooled with fog to about (i.e., within $\pm 10\%$ of) 200 degrees F. For an oil fired system, fogging to a temperature of about 250 degrees F. can be used.

The water supply to the fogger can be provided with a $NO_x$ reducing additive, such as ammonia or urea, to achieve further $NO_x$ reduction within smaller recirculating volumes of flue gas.

The invention has been described with reference to a particular preferred embodiment, but variations within the spirit and scope of the invention will occur to those skilled in the art. For example, while the invention is described in terms of a boiler system, it also has application to other burner-containing systems such as furnaces.

I claim:

1. A burner-containing apparatus having reduced noxious emissions, comprising:

a burner which receives input air and has an exhaust for exhausting flue gases;

a flue gas recirculation system for recirculating a portion of the flue gases back to an input of the burner;

means for humidifying the recirculated flue gases, said means comprising a fogging device which produces a fog from a fogger water supply and a fogger air supply.

2. Apparatus as defined by claim 1, wherein said fogging device comprises an ultrasonic fogging device.

3. Apparatus as defined by claim 1, further comprising means for sensing the temperature of the humidified flue gases, and means for controlling the amount of fogging as a function of the sensed temperature.

4. Apparatus as defined by claim 2, further comprising means for sensing the temperature of the humidified flue gases, and means for controlling the amount of fogging as a function of the sensed temperature.

5. Apparatus as defined by claim 3, wherein said means for controlling fogging is operative to increase fogging until the sensed temperature reaches a predetermined temperature.

6. Apparatus as defined by claim 4, wherein said means for controlling fogging is operative to increase fogging until the sensed temperature reaches a predetermined temperature.

7. A boiler apparatus having reduce noxious emissions, comprising:

a boiler having a burner which receives input air and has an exhaust for exhausting flue gases;

a flue gas recirculation system for recirculating a portion of the flue gases back to an input of the burner;

means for humidifying the recirculated flue gases, said means comprising a fogging device which produces a fog from a fogger water supply and a fogger air supply.

8. Apparatus as defined by claim 7, wherein said fogging device comprises an ultrasonic fogging device.

9. Apparatus as defined by claim 7, further comprising means for sensing the temperature of the humidified flue gases, and means for controlling the amount of fogging as a function of the sensed temperature.

10. Apparatus as defined by claim 8, further comprising means for sensing the temperature of the humidified flue gases, and means for controlling the amount of fogging as a function of the sensed temperature.

11. Apparatus as defined by claim 9, wherein said means for controlling fogging is operative to increase fogging until the sensed temperature reaches a predetermined temperature.

12. Apparatus as defined by claim 10, wherein said means for controlling fogging is operative to increase fogging until the sensed temperature reaches a predetermined temperature.

13. Apparatus as defined by claim 11, wherein said burner is natural gas fired, and said predetermined temperature is about 200 degrees F.

14. Apparatus as defined by claim 11, wherein said burner is oil fired, and said predetermined temperature is about 250 degrees F.

15. Apparatus as defined by claim 7, wherein said fogger water supply includes a $NO_x$ reducing chemical.

16. Apparatus as defined by claim 15, wherein said chemical is selected from the group consisting of urea and ammonia.

17. For use in an apparatus that contains a burner which receives input air and has an exhaust for exhausting flue gases, and has a flue gas recirculation system for recirculating a portion of the flue gases back to an input of the burner; a method for reducing noxious emissions, comprising humidifying the recirculated flue gases by fogging with an ultrasonic fogging device.

* * * * *